United States Patent [19]

Gunther et al.

[11] 4,247,734

[45] Jan. 27, 1981

[54] FLEXIBLE THERMOCOUPLE FOR VACUUM ELECTRIC FURNACES

[75] Inventors: Rush B. Gunther, Abington; Prem C. Jindal, Feasterville, both of Pa.

[73] Assignee: Abar Corporation, Feasterville, Pa.

[21] Appl. No.: 17,379

[22] Filed: Mar. 5, 1979

[51] Int. Cl.[3] ..... F27D 21/00

[52] U.S. Cl. ..... 13/24

[58] Field of Search ..... 13/20, 24; 73/341; 174/111, 19

[56] References Cited

U.S. PATENT DOCUMENTS

| | | | |
|---|---|---|---|
| 1,837,256 | 12/1931 | Egan . | |
| 1,944,449 | 1/1934 | Munro | 13/24 X |
| 2,837,654 | 6/1958 | Berghaus et al. . | |
| 3,437,784 | 4/1969 | Jones et al. . | |
| 3,650,930 | 3/1972 | Jones et al. . | |
| 3,694,628 | 9/1972 | McGwire et al. | 174/111 X |
| 3,761,370 | 9/1973 | Keller . | |
| 4,079,186 | 3/1978 | Lusk | 174/19 X |
| 4,109,157 | 8/1978 | Tanaka et al. . | |

OTHER PUBLICATIONS

Case Hardening, Metals Handbook, 1948, American Society for Metals, pp. 677–702.

*Primary Examiner*—Roy N. Envall, Jr.
*Attorney, Agent, or Firm*—Zachary T. Wobensmith, II; Zachary T. Wobensmith, III

[57] ABSTRACT

A flexible mounting for thermocouples for vacuum electric furnaces is described, which is particularly suitable for furnaces for nitrided or carburized case formation to avoid line of sight metallic deposition on the mounting from sputtering in the furnace and which could result in shorting, spaced shields being provided on the thermocouple mounting for this purpose.

7 Claims, 5 Drawing Figures

FLEXIBLE THERMOCOUPLE FOR VACUUM ELECTRIC FURNACES

BACKGROUND OF THE INVENTION

1. Field of the Invention

This invention relates to flexible thermocouple mountings having provisions to avoid metallic deposition on the mounting during case formation on ferrous articles.

2. Description of the Prior Art

It has heretofore been proposed, as described in American Society for Metals, Metal Handbook, Vol. 2, commencing at p. 677, to carburize the surface of a ferrous work piece or ion nitride the surface of the work piece to provide a case which may be hardened as the case is formed or which may subsequently be hardened.

Examples of ion nitriding by ionization in a chamber of a nitrogen containing gas are shown in the U.S. Pats. to Egan, No. 1,837,256, Berghaus et al., No. 2,837,654, Keller, No. 3,761,370, Jones et al., No. 3,437,784 and 3,650,930 and Tanaka et al., No. 4,109,157.

Materials that are sputtered from the work travel in straight lines, tend to build up on work supports and other exposed elements in the furnace and may cause electrical shorting. The tendency to shorting is greatly reduced in this structure by the use of shields which comprise insulating discs and spacers supported on the mounting.

SUMMARY OF THE INVENTION

In accordance with the invention a flexible thermocouple mounting is provided particularly for use in an ion carburizing or ion nitriding vacuum furnace and in which the mounting has spaced shields to reduce line of sight deposition from sputtering in the furnace on the thermocouple mounting.

It is the principal object of the invention to provide protective shielding for flexible thermocouple mountings in a vacuum furnace to prevent metallic deposition on the mounting resulting from sputtering in the furnace.

It is a further object of the invention to provide simple but effective shields of spaced discs.

It is a further object of the invention to provide shields of the character aforesaid which can be readily removed and replaced if desired.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 2:
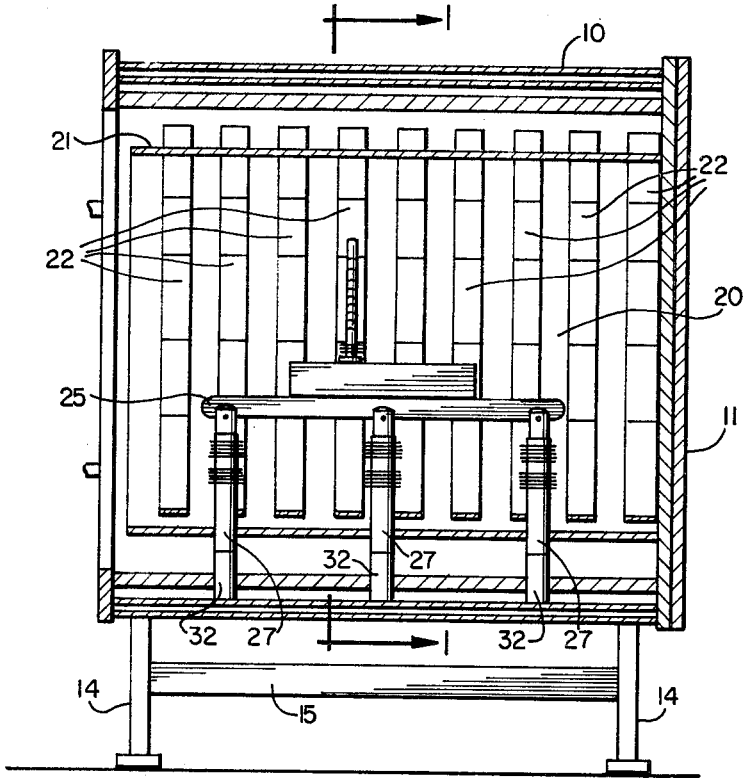
FIG. 2 is a longitudinal sectional view taken approximately on the line 2—2 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, in which a preferred embodiment of apparatus is illustrated, a vacuum furnace of any desired type is provided, the furnace illustrated being horizontal and preferably having an outer cylindrical wall or shell 10 closed at one end in any desired manner, such as by a door or an end closure plate 11. A door (not shown) is provided, hingedly mounted on the wall 10 at the other end and movable to a closed position with respect to the end flange 12 of the shell 10. Suitable vacuum tight packing (not shown) is interposed between the door (not shown) and the end flange 12 on the wall 10.

The shell 10 can be supported in any desired manner, such as by supports 14 with suitable intermediate bracing 15.

Suitable provisions (not shown) can be made for evacuating the furnace chamber and for providing a suitable gas or gas mixture to supply ions. One suitable apparatus for this purpose is shown in U.S. Pat. No. 4,124,199, dated Nov. 7, 1978 to William R. Jones and Prem C. Jindal.

A vacuum chamber 20 is thus provided within the shell 10, the closure wall 11 and the door (not shown).

Within the shell 10, a cylindrical ring heat shield 21 is provided for reflecting heat inwardly within the shell 10 and reducing heat leakage outwardly.

Within the shield 21, a plurality of spaced alloy metal strip type heating elements 22 are also preferably provided disposed from end to end within the chamber 20. The heating elements 22 are supported in any desired manner and are provided with insulated conductors 23 and 24 extending through sealing bushings 19 in the shell 10 for activation when desired.

Within the chamber 20, horizontal work supports of heat resistant metal of any suitable type are provided which include rails 25 extending lengthwise in the chamber 20. The rails 25 are carried and retained in rail holders 27. The rail holders 27 are supported by vertical support rods 30, preferably ceramic rods with suitable electrical insulating properties. This structure is shown in detail in the application of Rush B. Gunther and Prem C. Jindal for Letters Patent for Work Support for Vacuum Electrical Furnaces, filed Dec. 20, 1978, Ser. No. 971,483.

The support rods 30 are supported in sockets 32 of differing lengths to compensate for the curvature of the wall 10 and which are secured to the inner wall of the shell 10.

The support rods 30 on the exterior thereof, below the rail holders 27 are provided with a plurality of spaced discs 36 preferably formed of high temperature resistant non-electrical conductive material such as mica, asbestos, or other suitable material, supported on the rods 30 by a tube 41.

The thermocouple mounting includes a socket 45 welded in place in the wall 10 of the furnace with an exterior seal gland 46.

Figures 3, 4:
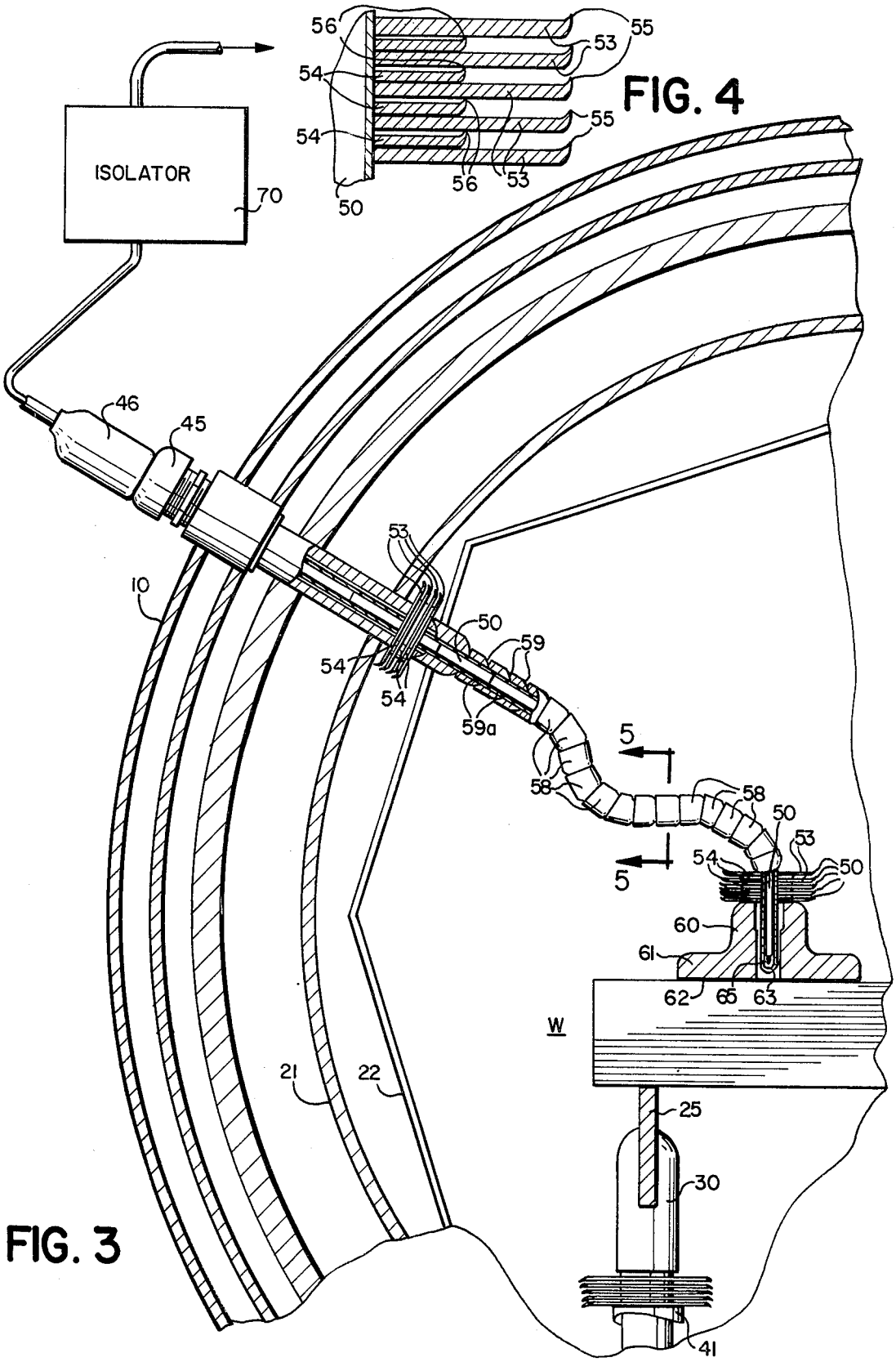
FIG. 3 is a fragmentary transverse sectional view, enlarged, taken approximately on the line 3—3 of FIG. 1.
FIG. 4 is an enlarged fragmentary sectional view showing the details of the spaced shielding discs.

A flexible thermocouple tube 50 extends inwardly through the socket 45 and has a plurality of spacer insulators 51, preferably of ceramic material thereon, at the inner end of which a plurality of spaced discs 53 are carried. (See FIG. 4) The discs 53 are preferably formed of high temperature resistant electrically non-conductive material such as mica, asbestos or other similiar material with discs 54 of smaller diameter to provide spaces between the discs 53.

The outer margins 55 and 56 of the discs 53 and 54 are preferably curled in the direction in which shielding is desired.

The thermocouple tube 50 also has thereon a plurality of beads 58 with cylindrical exteriors and convex curved ends 59 received in complemental sockets 59*a*. The beads 58 are of ceramic refractory material resistant to the interior temperatures of the furnace.

In closely spaced relation to the work piece W an inner group of discs 53 and 54 are provided on the tube 50 similar to those previously described. It is preferred that each group of discs 52 comprises five large discs 53 and interposed smaller discs 54. A tubular shield 60 of metal is carried on the end of the tube 50 at the work piece W which has an enlarged head 61, with a lower face 62 for engagement with the work piece W carried on the rails 25.

Figure 5:
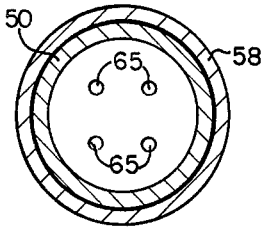
FIG. 5 is a transverse sectional view, enlarged, taken approximately on the line 5—5 of FIG. 3.
Figure 1:
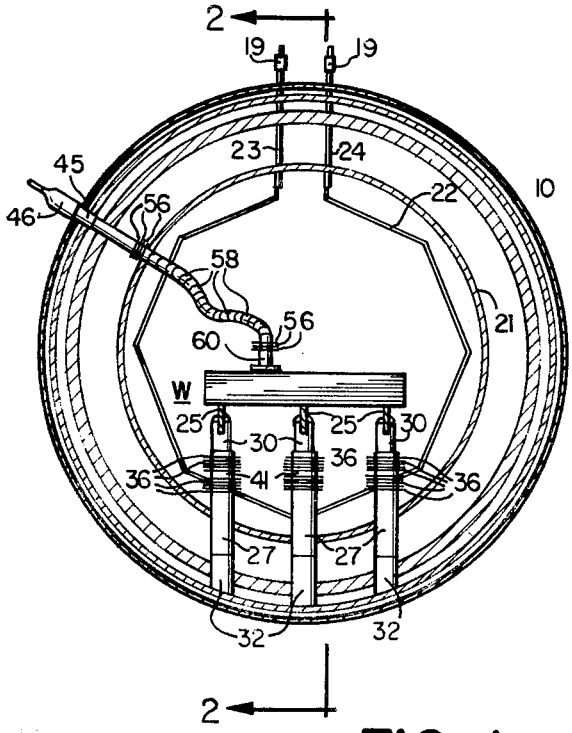
FIG. 1 is a transverse sectional view of a vacuum furnace chamber taken approximately on the line 1—1 of FIG. 2.

The tube 50 has a closed end 63 located close to but spaced from the face 62. Within the tube 50 at least one pair of bimetal thermocouple wires 65 is provided, welded at their ends close to the closed end 63 of the tube 50. A plurality of pairs 65 (see FIG. 5) may be provided so that in the event of failure of one pair another pair may be utilized to determine the prevailing temperature.

If desired, and in order to protect the measuring instruments (not shown) to which the thermocouple pairs 65 are connected, an electric isolator 70 may be employed to prevent electrical discharge of excessive voltage through the measuring instruments.

In use metallic material from the sputtering at the work piece W in its line of sight movement will be prevented by inner group of shields 53, 54 from depositing on portions of the beads 58 contiguous to the shields 53, 54 and the shield 60, and by the group of shields 53, 54 outwardly of the heating elements 22 from depositing on contiguous and shielded portions of the spacer insulators 51.

It will be noted that the assembly and disassembly of the tubular shield 60, the discs 53 and 54, the beads 58 and spacer insulator 51 can be readily effected so that inspection, maintenance and replacement, as necessary, of various components can be quickly and easily carried out.

The tube 50, with its enclosed thermocouple wires 63, can also be readily detached.

We claim:

1. A flexible thermocouple assembly for vacuum electric furnaces having a hostile environment therein comprising a flexible thermocouple enclosing tube having thermocouple wires therein and a closed inner terminal end with the wires terminating therein, members for supporting said tube in said furnace, a plurality of beads of ceramic material on said tube in covering relation thereto and movable to accommodate bending of said tube, a tubular shield for the terminal end of said tube for disposition at a work piece, and at least one group of spaced shielding members of different diameters alternately mounted on said tube between said tubular shield and said plurality of beads, said shielding members extending outwardly from said tube and being retained in position on said tube by one of said beads.

2. The combination defined in claim 1 in which an additional group of spaced shielding members is provided contiguous to a wall of the furnace.

3. The combination defined in claim 1 in which said shielding members are of heat resistant non-electrical conducting material.

4. The combination defined in claim 3 in which said shielding members comprise separable spaced discs.

5. The combination defined in claim 1 in which the edges of said shielding members have rim portions facing in a predetermined direction.

6. The combination defined in claim 7 in which said tubular shield, said spaced shielding members and said beads are disposed in sequence on said tube.

7. The combination defined in claim 4 in which said tubular member, a group of said spaced shielding members, a plurality of said beads, and another group of said spaced shielding members are disposed in sequence on said tube.

* * * * *